United States Patent [19]

Nakagama et al.

[11] Patent Number: 5,065,190

[45] Date of Patent: Nov. 12, 1991

[54] TONER DENSITY CONTROL METHOD

[75] Inventors: Kiyohari Nakagama; Kohji Ishii, both of Hachioji, Japan

[73] Assignee: Konica Corporation, Tokyo, Japan

[21] Appl. No.: 585,383

[22] Filed: Sep. 20, 1990

[30] Foreign Application Priority Data

Oct. 6, 1989 [JP] Japan ..... 1-261456

[51] Int. Cl.[5] ..... G03G 21/00

[52] U.S. Cl. ..... 355/246; 355/208

[58] Field of Search ..... 355/246, 245, 208, 204; 118/688, 689, 691

[56] References Cited

U.S. PATENT DOCUMENTS 4,589,762 5/1986 De Schamphelaere et al. ... 355/246 X 4,607,944 8/1986 Rushing ..... 355/246

4,610,532 9/1986 DeSchamphelaere et al. .... 355/246

4,647,185 3/1987 Takeda et al. ..... 355/246 X 4,708,458 11/1987 Ueda et al. ..... 355/246 X 4,758,861 7/1988 Nakamaru etal. ..... 355/208

4,875,078 10/1989 Resch, III et al. ..... 355/245 X 4,932,356 6/1990 Watanabe et al. ..... 355/208 X

*Primary Examiner*—A. T. Grimley

*Assistant Examiner*—Shuk Y. Lee

*Attorney, Agent, or Firm*—Jordan B. Bierman

[57] ABSTRACT

A toner density control method wherein a change in a toner density when a developer of a standard density is stirred, a correction coefficient is calculated from the change, and a toner density of the developer of the standard density under stable condition is calculated from the toner density of the developer which has been stirred and from the correction coefficient, in order to control the toner density.

11 Claims, 4 Drawing Sheets

TONER DENSITY CONTROL METHOD

BACKGROUND OF THE INVENTION

1. Field of the Invention

The present invention relates to a toner density control method in a developing device used for such image forming apparatuses as electrophotographic reproducing machine and like machines. More specifically, the invention relates to a toner density control method which is capable of precisely controlling the toner density.

2. Description of the Prior Art

An electrophotographic reproducing machine is the apparatus in which an electrically charged photosensitive member (the description hereinafter refers to a photosensitive drum) is exposed to light depending upon the document information to form an electrostatic latent image thereof, the latent image is visualized with toner, and the toner visible image is transferred onto a transfer paper and is fixed. In recent years, the electrophotographic reproducing machines of this kind have been used in every field of industries.

A developing device used for the electrophographic reproducing machines of this kind makes use of a two-component developer which is composed of a toner and a carrier (iron powder). The toner is gradually consumed during developing depending upon the kind and quantity of documents, and the toner density in the developer decreases gradually, which makes it necessary to appropriately replenish the toner. If the toner density is too high, the obtained image density becomes too great and fog often develops.

If the toner density is too low, on the other hand, not only the image density becomes small but also the developer loses durability drastically. For instance, when the toner densities are maintained at 5% and 2%, the durability at the latter density becomes shorter than one-half that at the former density.

Therefore, the mixing ratio of the toner to the carrier must be maintained constant at all times. For this purpose, it has been attempted to detect the toner density in the developer by some means and to so replenish the toner that the detected density value becomes in agreement with a predetermined standard value of density.

There has been proposed a toner density detecting system using inductance to detect the toner density in the developing device that uses a two-component developer. According to this system which utilizes the fact that the carrier included in the developer is a magnetic material, an inductance sensor with coil is disposed in the developing device in order to detect the toner density. Concretely speaking, the toner density is found by measuring the permeability of the developer based on the fact that the mixing ratio of the toner to the carrier varies with a change in the toner density causing the permeability to change.

The output voltage of the inductance sensor is compared with a reference voltage, the toner is so replenished that the output voltage of the inductance sensor will become equal to the reference voltage and, thus, the toner density is controlled to become constant. Such technology has been described in Japanese Patent Publication Nos. 28305/1988 and 5299/1989.

The reference voltage that is used for comparison at the time when the toner is replenished is obtained by throwing a standard developer into the developing device followed by stirring for a predetermined period of time and storing the voltage detected by the inductance sensor in a nonvolatile memory. Generally, the stirring time is set to be, for instance, three minutes, and the density of the standard developer stirred for three minutes is stored in the nonvolatile memory to control the toner density.

In practice, however, the standard developer may have variance to some extent, and the density may not often be stabilized within a predetermined period of time. Moreover, the density may not often be stabilized within a predetermined period of time in the case of the standard developer that was produced a given period of time (several months to one year) ago.

FIG. 4 is a graph showing relationships between the stirring time and the voltage detected by the inductance sensor using a standard developer A just after the production and a standard developer B after a given period of time from the production.

In FIG. 4, the standard developer A represented by solid line is stabilized after the stirring time of about three minutes, but the standard developer B is stabilized for the first time after the stirring time of 10 minutes. In the case of the developer B, if the detected value after the stirring time of three minutes is written onto the nonvolatile memory, the toner density is controlled being deviated from a point of stabilization, and is settled to a density deviated from a proper value. In the case of the developer B of FIG. 4, therefore, the toner density is controlled to become lower than the proper density. Accordingly, the quality of image becomes poor and the life of the developer is shortened.

SUMMARY OF THE INVENTION

The present invention was accomplished in view of the above-mentioned problems, and its object is to realize a toner density control method which is capable of correctly detecting the initial value of toner density of the standard developer and of maintaining the toner density correctly and constantly at all times.

In order to solve the aforementioned problems, the present invention deals with a toner density control method which stores an initial value of toner density of a developer of a standard density which has been stirred for a predetermined period of time, and controls the toner density based upon the toner density that is stored, wherein a change between a toner density of the developer during the stirring thereof and a toner density of the developer which has been stirred is detected, a correction coefficient is calculated from the change, and a toner density of the developer of the standard density under stable condition is calculated from the toner density of the developer which has been stirred and from the correction coefficient and is stored. In the present invention, the correction coefficient is calculated from the change in the toner density of the standard developer during the stirring and in the toner density after the stirring, the toner density of the developer having standard density under stable condition is calculated from the toner density after the stirring and from the correction coefficient, and the thus calculated toner density is written onto a nonvolatile memory.

The other objects and features of the present invention will be described hereinbelow in conjunction with the drawings.

DESCRIPTION OF THE PREFERRED EMBODIMENT

Figure 1:
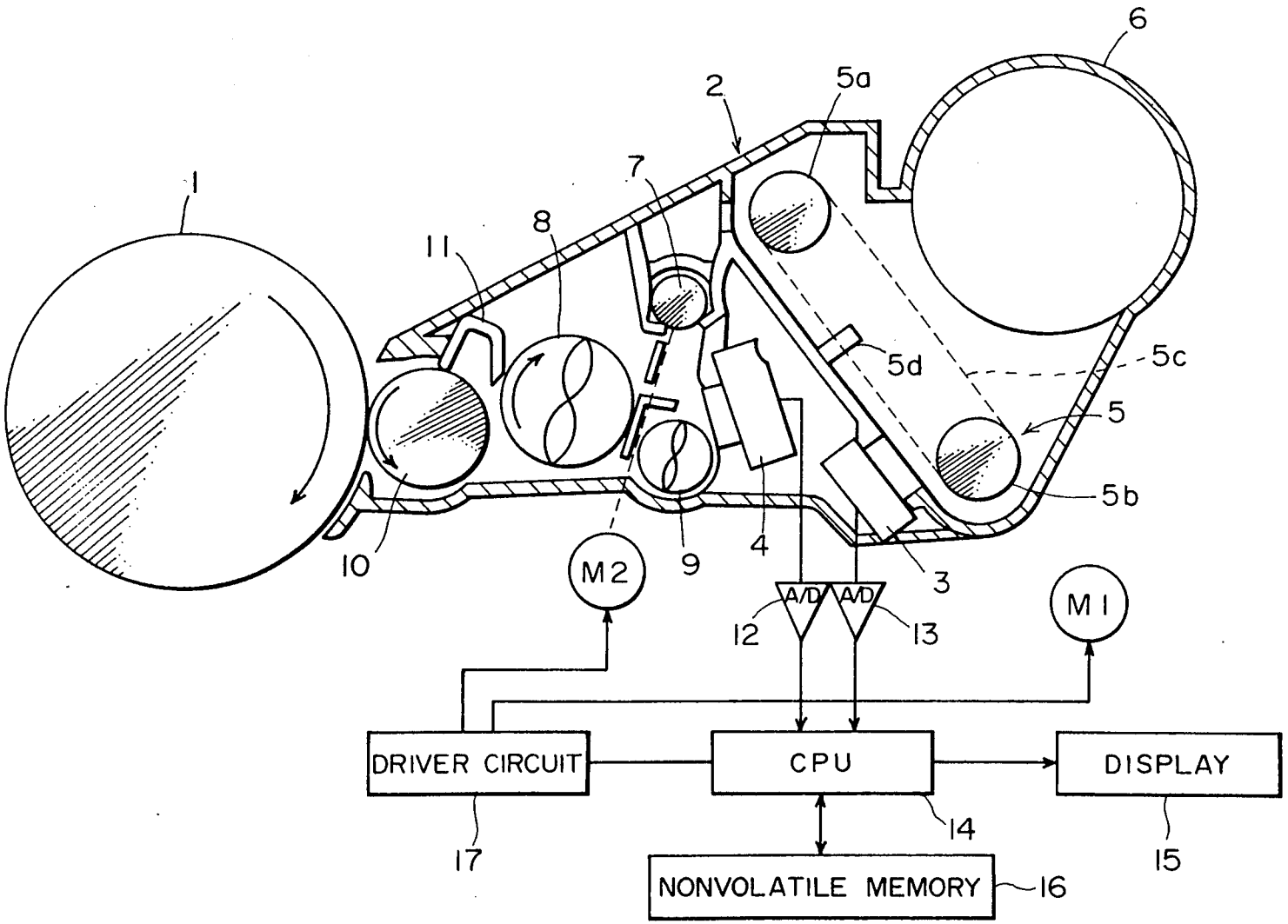
FIG. 1 is a diagram illustrating the constitution of a developing device used in an embodiment of the present invention.

FIG. 1 is a diagram which illustrates in cross section the electrical constitution of a developing device adapted to a toner density control method according to an embodiment of the present invention.

In FIG. 1, reference numeral 1 denotes a photosensitive drum, 2 denotes a developing device, 3 denotes a remaining toner amount sensor that detects the remaining amount of toner from vibration at the time of replenishing the toner, 4 denotes an inductance sensor that detects the toner density in the developer, 5 denotes a feeding mechanism for replenishing the toner, reference numerals 5*a* and 5*b* denote rollers that are driven when the toner is to be replenished, 5*c*denotes a belt driven by the rollers 5*a* and 5*b*, reference numeral 5*d* denotes a carriage that is mounted on the belt 5*c* to replenish the toner, 6 denotes a toner replenishing port, 7 denotes an auxiliary roller for delivering the toner that is replenished by the carriage 5*d* of the toner replenishing means, 8 denotes a main stirring unit for stirring the developer composed of a toner and a carrier, 9 denotes a sub-stirring unit for stirring the developer, 10 denotes a developing sleeve that adheres the toner onto the electrostatic latent image on the photosensitive drum 1 to effect developing, and 11 denotes an ear restricting plate for restricting the height of ear of the developer on the developing sleeve. Reference numeral 12 denotes an A/D converter which converts a voltage value corresponding to the toner density detected by the inductance sensor 4 into a digital value, 13 denotes an A/D converter that converts a voltage value corresponding to the remaining amount of toner detected by the remaining toner amount sensor 3 into a digital value, 14 denotes a CPU that controls each of the portions, 15 denotes a display unit for displaying message from the CPU 14, reference numeral 16 denotes a nonvolatile memory onto which will be written, according to a write instruction, the toner density that is converted into the digital value by the A/D converter 12 and that is corrected by the CPU 14 and from which will be read out the toner density, reference numeral 17 denotes a driver circuit that forms signals for driving a motor upon receipt of an instruction from the CPU 14, symbol Ml denotes a motor that drives the feeding mechanism upon receipt of an instruction from the driver circuit 17, and M2 denotes a motor that drives the auxiliary roller 7 upon receipt of an instruction from the driver circuit 17.

First, operation of the developing device 2 will be described. The toner supplied from the toner replenishing port 6 is transferred, when there is a toner replenishing instruction, onto the auxiliary roller 7 by the carriage 5*d* of the feeding mechanism 5. At this moment, the remaining toner amount sensor 3 detects the remaining toner amount of toner based upon vibration generated when the toner is carried by the carriage 5*d*. The auxiliary roller 7 permits the toner to fall downwardly. The toner is then stirred together with the developer (toner and carrier) existing already in the developing device by the main stirring unit 8 and the sub-stirring unit 9. Here, the inductance sensor 4 measures the permeability of the developer in order to detect the toner density. Ear of the developer is formed on the developing sleeve. The height of ear of the developer is restricted by the ear restricting plate 11 and latent image on the photosensitive drum 1 is developed with the developer that passed therethrough, so that toner image is obtained.

Figure 2:
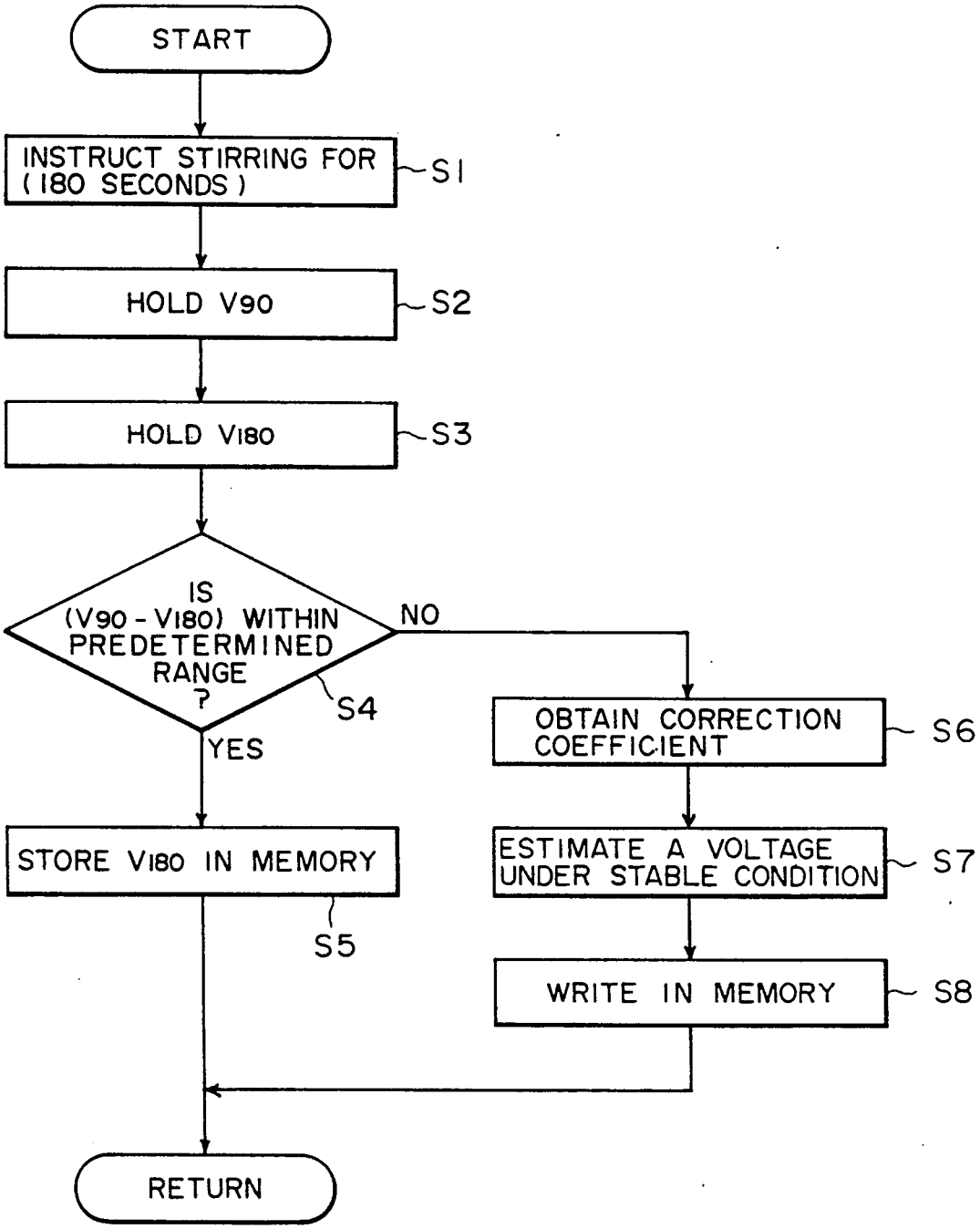
FIG. 2 is a flow chart illustrating the steps in the method of the present invention.

Next, the initial setting operation will be described with reference to the flow chart of FIG. 2.

When there is an instruction of initial setting, the CPU 14 instructs the main stirring unit 8 and sub-stirring unit 9 in the developing device 2 to stir the developer for a predetermined period of time (until the toner and carrier in the developer are mixed together well, for instance, for 180 seconds)(S1). At the initial moment, the developer having a reference density (e.g., a toner density of 4%) is supplied into the developing device. During the stirring (e.g., after 90 seconds from the start of stirring), a value detected by the inductance sensor is held as $V_{90}$ in a register in the CPU 14 (S2). In order to correctly detect $V_{90}$, voltages detected after 89 seconds, 90 seconds, 91 seconds and 92 seconds should be averaged. At the time when the stirring is finished, a value detected by the inductance sensor is held as $V_{180}$ in the register in the CPU 14 (S3). In order to correctly detect $V_{180}$, voltages detected after 180 seconds, 181 seconds, 182 seconds and 183 seconds from the completion of stirring should be averaged.

Figure 4:
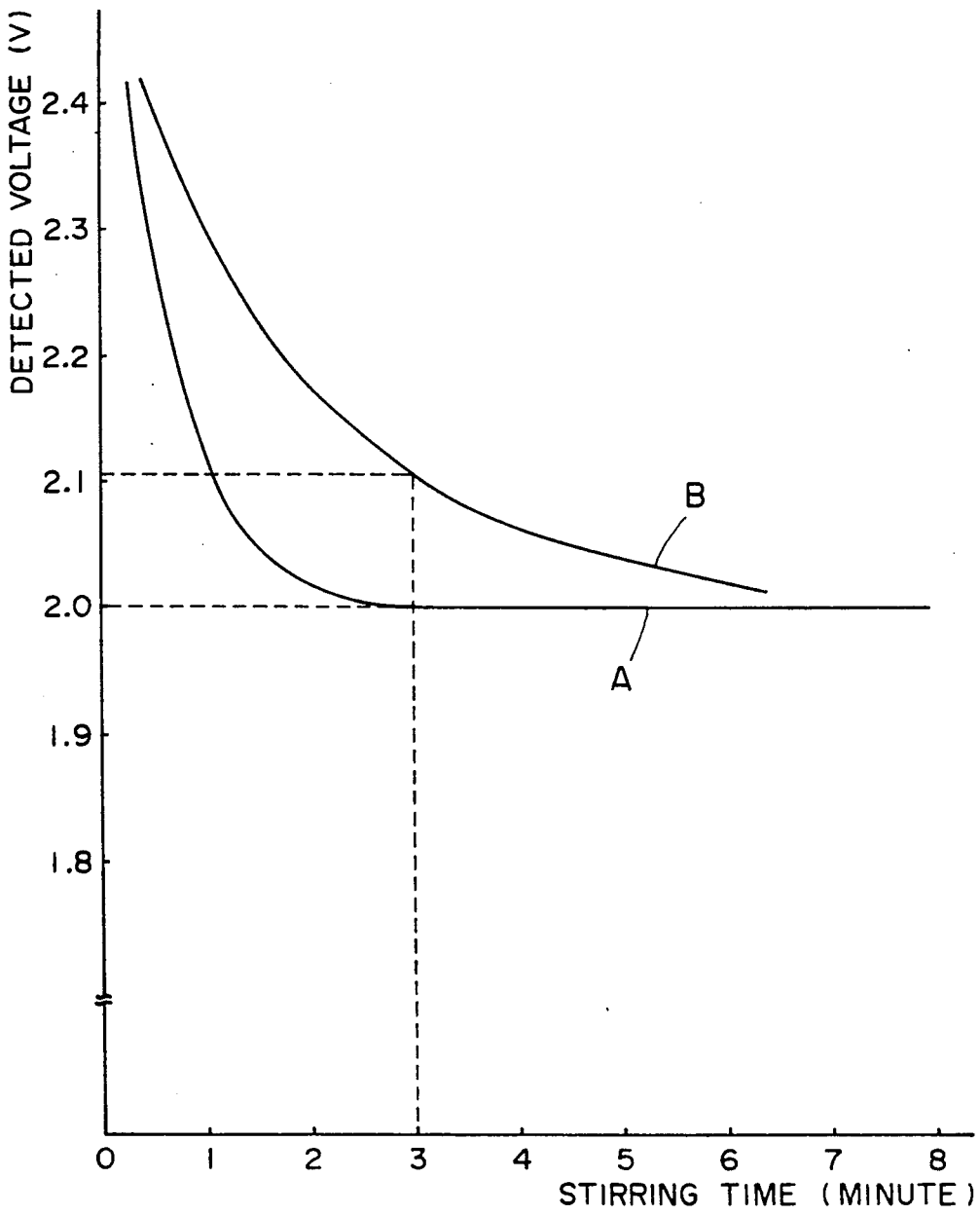
FIG. 4 is a diagram of characteristics showing relationships between the stirring time of the developers and the voltage detected by the inductance sensor.

Here, the CPU 14 calculates a differential voltage V' between $V_{90}$ and $V_{180}$ (S4) That is, when the differential voltage lies within a predetermined range, it is considered that the detected value $V_{180}$ is under a stable condition (see curve A of FIG. 4). Therefore, the value $V_{180}$ is stored in the nonvolatile memory 16 (S5). When the differential voltage V' lies outside the predetermined range, it is considered that the detected value is under unstable condition (see curve B of FIG. 4). Therefore, a correction coefficient Vx is found (S6). That is, there exists a correlationship between the differential voltage V' and $V_{180}$ to $V_{600}$ (voltage obtained after the stirring was effected for 10 minutes), enabling the stable condition to be estimated from the differentail voltage V'.

By calculating $V_{180}$ and Vx, therefore, the detected value of under the stable condition is found (S7). The thus found value is written onto the nonvolatile memory 16 (S8).

The operation of initial setting is completed at a moment when the above value is just written onto the nonvolatile memory 16.

Thereafter, the toner is replenished with the value written onto the nonvolatile memory 16 as a reference.

Figure 3:
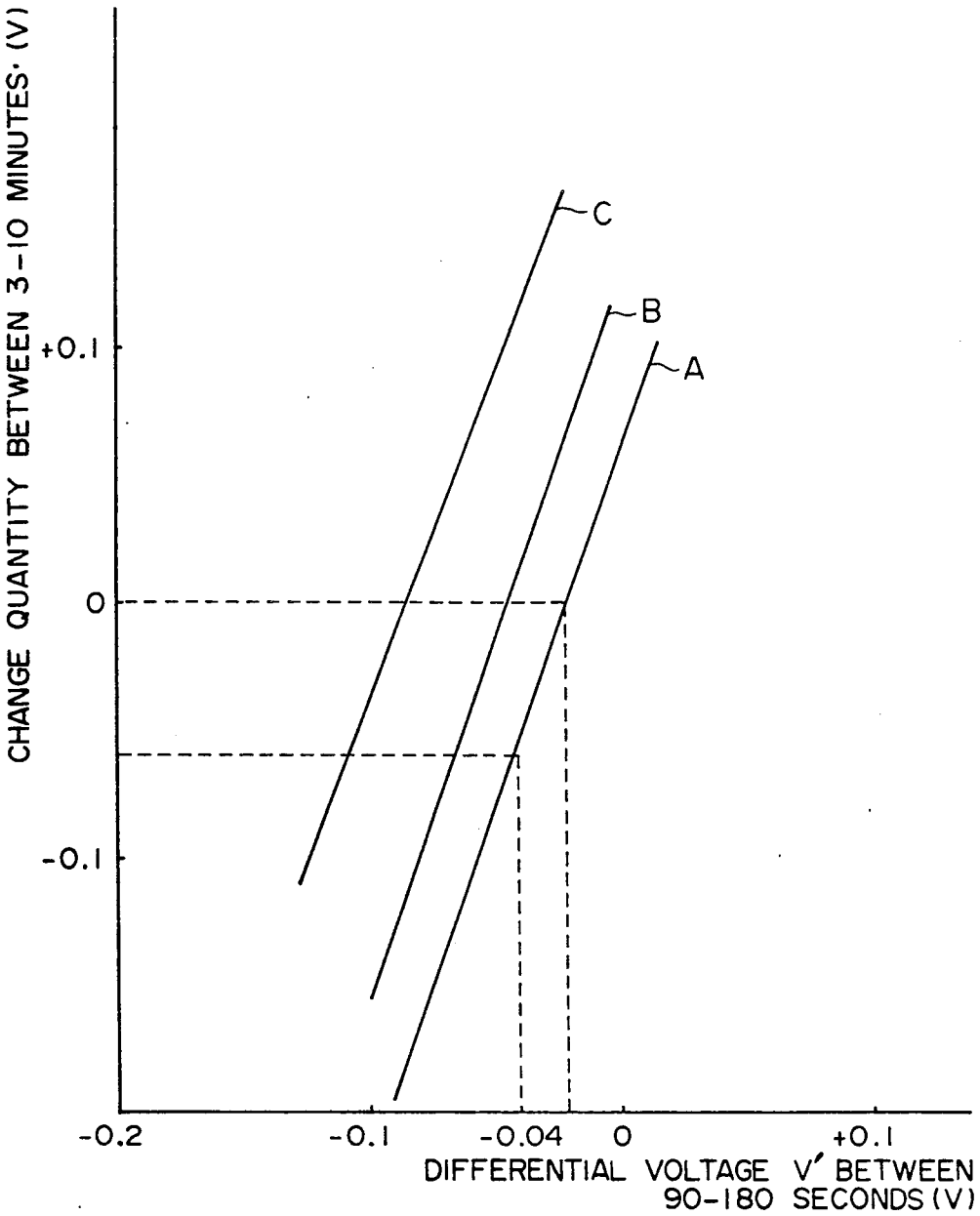
FIG. 3 is a diagram showing detected voltage change characteristics of when the developers are being stirred.

FIG. 3 is a diagram of characteristics showing relationships between the differential voltage V' of toner density and $V_{180}$ to $V_{600}$ (change quantities of three minutes to ten minutes) found through experiments. In FIG. 3, lines A, B and C represent different kinds of developers. For instance, when $V' > -0.04$ while using the developer A, $V_{180}$ to $V_{600}$ change is small. Therefore, no correction is effected but $V_{180}$ is directly written onto the nonvolatile memory 16 and when $V' < -0.04$, a predetermined determined value (e.g., 0.08) can be used as a correction value Vx. This can be realized based on a simple constitution. Though $V' = -0.04$ was used as a threshold value and $Vx = 0.08$ as a correction value, these values may be changed depending upon the kind of the developer.

Instead of setting the correction value to a predetermined value, furthermore, it can be contrived to store in the CPU 14 a correction program based on a logistic curve or a like curve and to estimate a stabilized value to write it onto the nonvolatile memory 16.

As described above, the change quantity in the toner density of the reference developer during the stirring is detected at the time of initial setting, a value under stable condition is calculated from the change quantity, and the thus calculated value is written onto the nonvolatile memory. It is therefore possible to realize an image forming apparatus which is capable of correctly detecting the toner density of the standard developer and of maintaining the toner density constant at all times.

According to the present invention as described above in detail, a correction coefficient is calculated from the change quantities in the toner density during the stirring and in the toner density after the completion of stirring, and the toner density of the developer of the standard density under stable condition is calculated from the toner density after the completion of stirring and from the correction coefficient. It is therefore made possible to realize a toner density control method which is capable of correctly detecting the initial value of toner density of the standard developer and of correctly and easily maintaining the toner density of the developer constant at all times.

What is claimed is:

1. A method for controlling a toner density of a two component developer which comprises a toner and a carrier, said method comprising (a) stirring said developer for a predetermined time, (b) detecting a first toner density value at a certain time during said stirring and detecting a second toner density value when said stirring is completed, (c) determining a reference density value based on said first value an said second value, (d) storing the reference value in a memory, and (e) controlling said toner density based on said reference value.

2. The method of claim 1 wherein said reference value is said toner density of said developer when said developer is in stable condition.

3. The method of claim 1 wherein said determining further comprises calculating a correction coefficient based on said first value and said second value.

4. The method of claim 3 wherein said reference value is determined based on said correction coefficient and said second value.

5. The method of claim 1 wherein said determining further comprises calculating a difference between said first value and said second value.

6. The method of claim 5 wherein said determining further comprises comparing said difference with a predetermined range.

7. The method of claim 6 wherein the second value is said reference value when said difference is smaller than said predetermined range.

8. An apparatus for controlling a toner density of a two component developer which developer comprises a toner and a carrier, said apparatus comprising (a) a stirring device for stirring said developer for a predetermined time, (b) a detection device for detecting a first toner density value at a certain time during stirring and a second toner density value when stirring is completed, (c) a calculator for calculating a reference value based on said first value and said second value, (d) a storage device for storing the reference value, and (e) a control for controlling said toner density based on said reference value.

9. The apparatus of claim 8 further comprising a calculating device for calculating a correction coefficient based on said first value and said second value.

10. The apparatus of claim 8 further comprising a calculating element for calculating a difference between said first value and said second value.

11. The apparatus of claim 10 further comprising a comparator for comparing said difference with a predetermined range.

* * * * *